United States Patent [19]

Kreider et al.

[11] 4,102,637

[45] Jul. 25, 1978

[54] WORK SUPPORT FOR VACUUM ELECTRIC FURNACES

[75] Inventors: Benjamin A. Kreider, Richboro; William J. Metalsky, Warminster, both of Pa.

[73] Assignee: Abar Corporation, Feasterville, Pa.

[21] Appl. No.: 723,767

[22] Filed: Sep. 16, 1976

[51] Int. Cl.[2] ..... F27D 5/00

[52] U.S. Cl. ..... 432/227; 432/235; 432/249; 432/253; 13/32; 13/33; 165/180; 165/DIG. 7

[58] Field of Search ..... 432/77, 81, 173, 198, 432/227, 230, 231, 238, 233–235, 241, 253, 254, 256, 249; 165/80, 180, DIG. 7; 266/249, 250; 13/20, 32, 33

[56] References Cited

U.S. PATENT DOCUMENTS

| | | | |
|---|---|---|---|
| 3,307,619 | 3/1967 | Kim | 165/80 |
| 3,463,470 | 8/1969 | Green et al. | 432/241 |
| 3,792,318 | 2/1974 | Fries et al. | 165/80 |
| 3,940,245 | 2/1976 | Smith, Jr. et al. | 432/249 |
| 3,971,875 | 7/1976 | Regalbuto | 432/241 |
| 4,003,697 | 1/1977 | Elmgren | 432/238 |

*Primary Examiner*—John J. Camby
*Assistant Examiner*—Henny C. Yuen
*Attorney, Agent, or Firm*—Zachary T. Wobensmith, Jr.; Zachary T. Wobensmith, III

[57] ABSTRACT

A work support for vacuum electric furnaces is disclosed which supports a work piece in flat condition within close tolerances and which includes a plurality of spaced vertical pins with a heat sink through which the pins extend, the support being removable and remachinable to retain the desired flatness.

12 Claims, 5 Drawing Figures

WORK SUPPORT FOR VACUUM ELECTRIC FURNACES

BACKGROUND OF THE INVENTION

1. Field of the Invention

This invention relates to work supports for vacuum electric furnaces, including hot press furnaces.

2. Description of the Prior Art

Various work supports have heretofore been proposed for work pieces which are exposed to high temperatures of the order of 800° F and higher in a vacuum electric furnace.

None of the supports now available provide a suitable flat support within close tolerances for the conditions of heating and cooling to which the work piece may be subjected including hot press operation, heat treating, brazing and the like.

SUMMARY OF THE INVENTION

In accordance with the invention a work support is provided for vacuum electric furnaces which is of unitary construction so as to be insertable into and removable from the furnace and which includes a plurality of spaced vertical posts or pins with a heat sink through which the posts or pins extend, the support being flat with close tolerances for supporting a flat work piece.

It is the principal object of the invention to provide a work support for flat work pieces in which the flatness is to close tolerances.

It is a further object of the invention to provide a work support of the character aforesaid of unitary construction for insertion into and removal from the furnace.

It is a further object of the invention to provide a work support of the character aforesaid which includes a heat sink and, if desired, a heat shield.

It is a further object of the invention to provide a work support of the character aforesaid which is of adequate strength for use in a hot press furnace.

It is a further object of the invention to provide a work support having a wide range of usefulness for flat work pieces.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
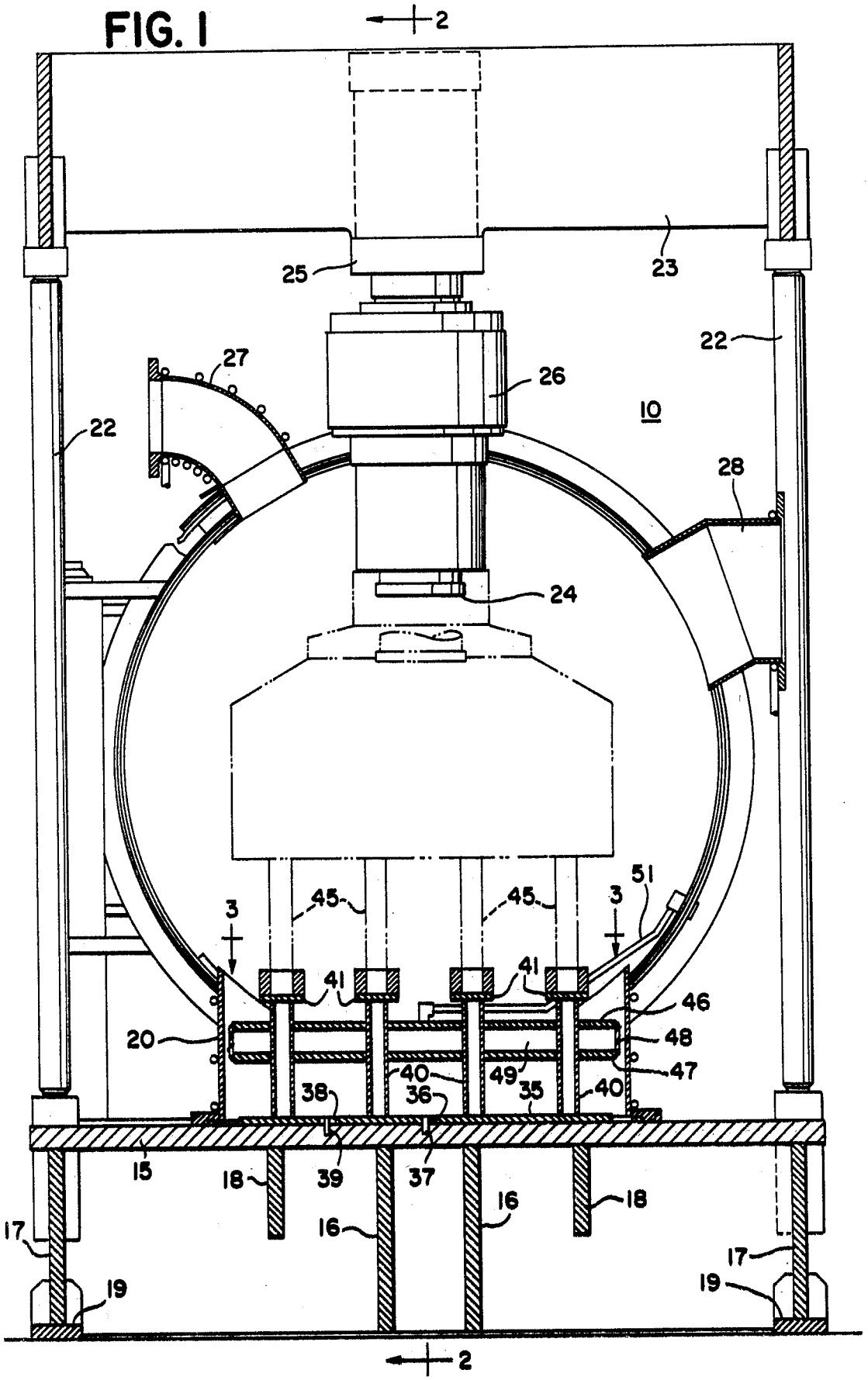
FIG. 1 is a transverse vertical sectional view of a furnace having a work support in accordance with the invention mounted therein and taken approximately on the line 1—1 of FIG. 2; the heating elements and heat shields being omitted.
Figure 2:
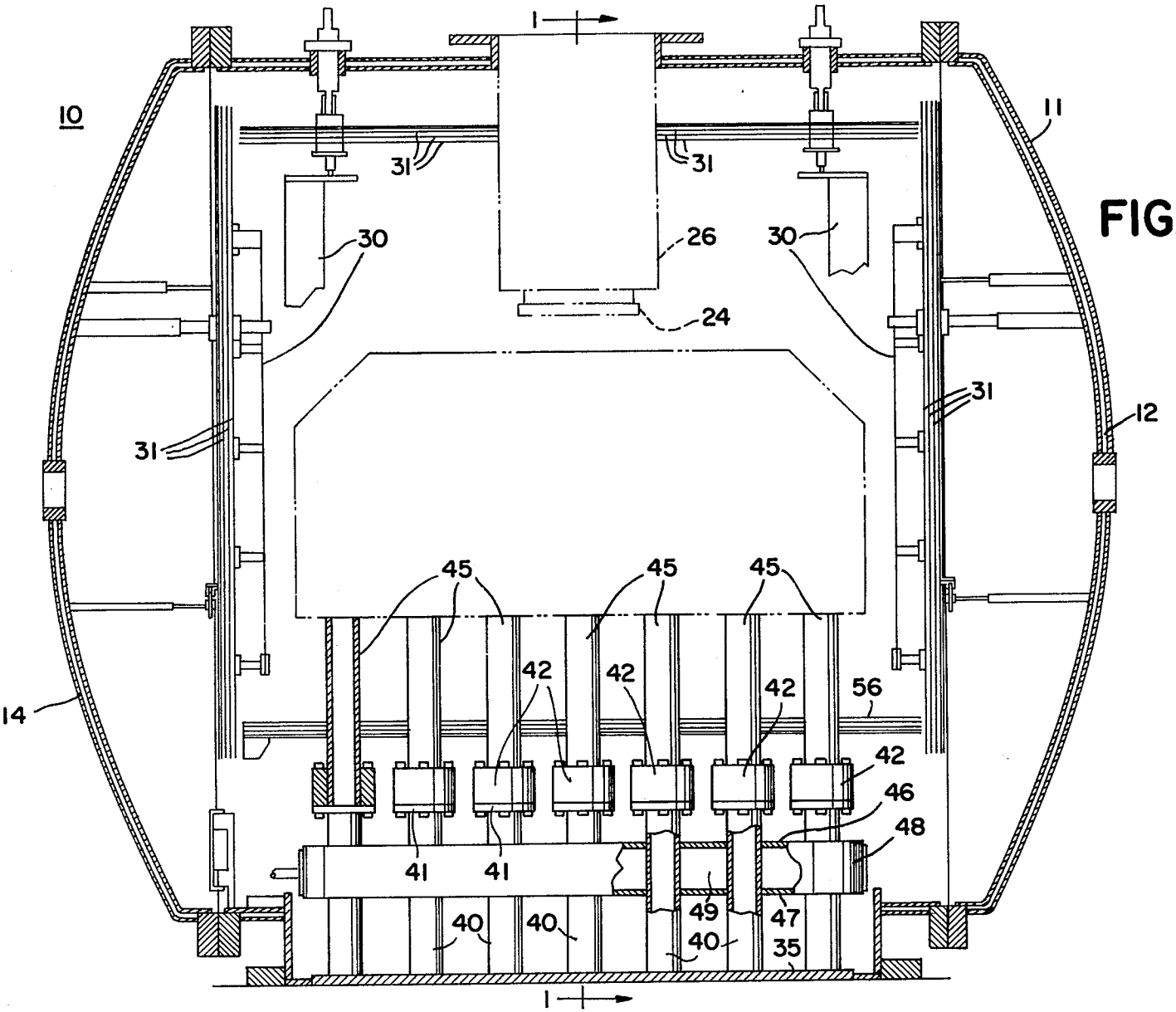
FIG. 2 is a vertical sectional view of the furnace shown in FIG. 1 taken approximately on the line 2—2 of FIG. 1.
Figure 3:
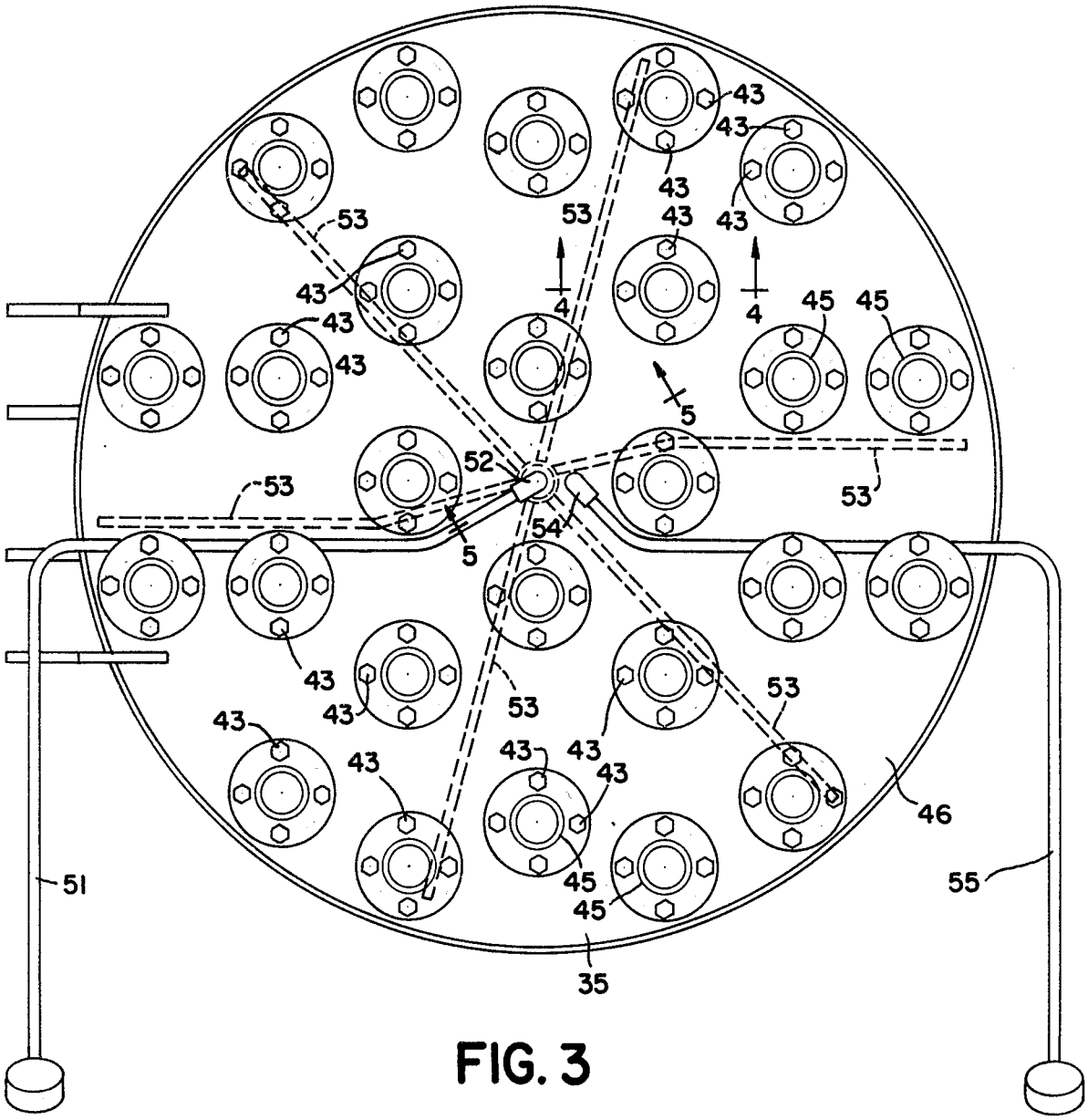
FIG. 3 is a horizontal sectional view taken approximately on the line 3—3 of FIG. 1.
Figure 4:
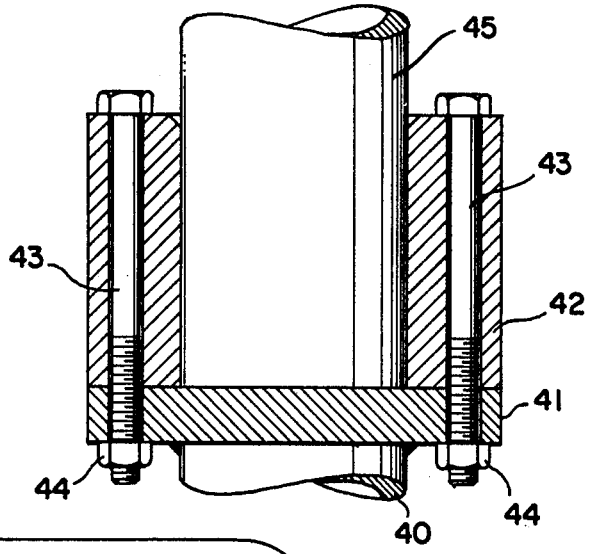
FIG. 4 is a vertical sectional view, enlarged, taken approximately on the line 4—4 of FIG. 3.
Figure 5:
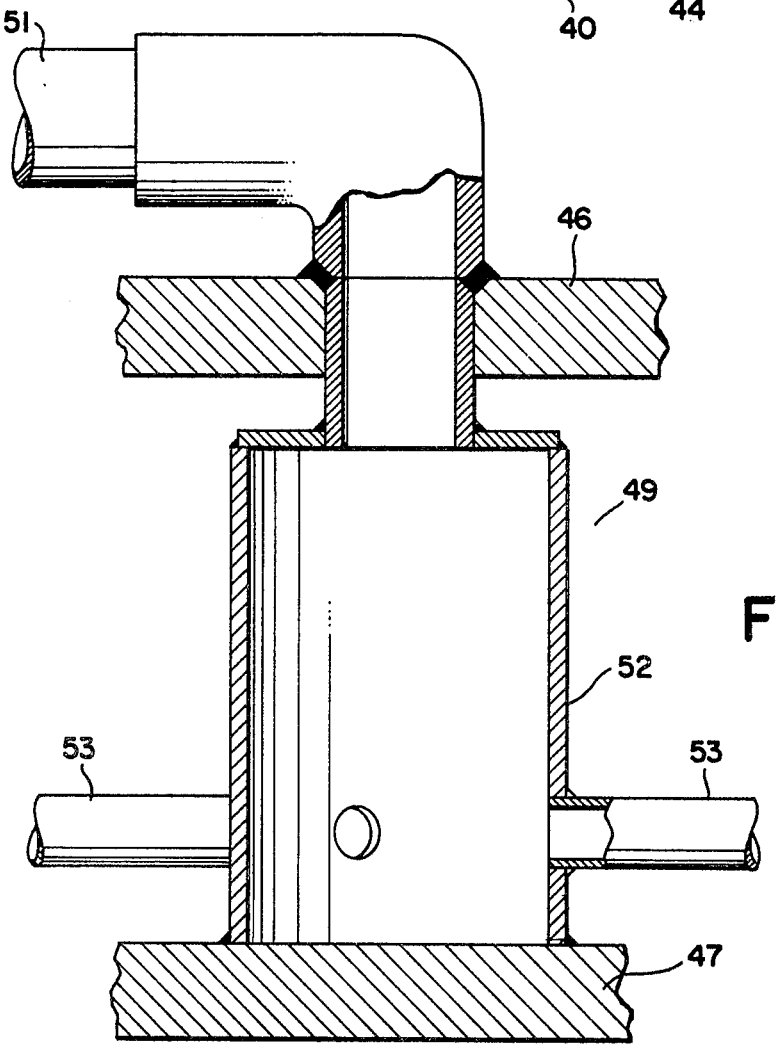
FIG. 5 is a vertical sectional view, enlarged, taken approximately on the line 5—5 of FIG. 3.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings a vacuum electric furnace 10 is shown for purposes of illustration. The furnace 10 includes a metal tank 11 shown as of cylindrical shape with its cylindrical axis horizontal. The walls of the tank 11 are of sufficient thickness to withstand the forces to which they are subjected under vacuum and when internally heated.

The tank 11 is closed at its rear end by a fixed wall 12 and has a hingedly mounted vertical front door 14 for access to the interior and gasketed to prevent leakage when the door 14 is closed.

The tank 11 is supported in any desired manner in spaced relation above the floor, the tank 11 here illustrated having a horizontal press bed or frame plate 15 with central vertical stiffeners 16, vertical side frame plates 17 and stiffeners 18 secured thereto. The plates 17 are secured to horizontal base plates 19.

Vacuum chamber nozzle 20 connected to and extending between the press bed 15 and the tank 11 provides with the interior of the tank 11 a vacuum and gas tight enclosure.

The specific furnace 10 illustrated is of the hot press type and has vertical posts 22 which support an upper press frame 23 which carries a press plunger 24 and hydraulic actuating cylinder 25 therefor. A flexible vacuum and gas tight joint 26 is provided for the plunger 24. A fluid connection 27 is provided, if desired, connected to the interior of the tank 11 for the withdrawal of purging gas, which is supplied through fluid connections (not shown).

A fluid exhaust connection 28 is provided connected to the interior of the tank 11 and to an exhausting system to quickly achieve and maintain the desired vacuum within the tank 11 and may, if desired, include motor driven roughing and holding pumps and a diffusion pump.

The tank 11, rear wall 12 and door 14 can be provided with heating elements 30 and shields 31 in a well known manner.

The structure heretofore described is merely by way of illustration and for aiding in understanding the present invention which is not limited to use with the specific furnace shown nor with a press furnace.

The work support to be described includes a mounting plate 35 shown as circular in shape for the specific furnace 10 in which it is used. The mounting plate 35 has a central locating opening 36 for engagement by a central pin 37 in the press bed plate 15 and a radially disposed elongated opening 38 for reception of a radially disposed pin 39 in the press bed plate 15.

The mounting plate 35 has secured to the top face thereof preferably be welding, and at desired spaced locations determined by the load to be supported, a plurality of hollow lower tubular pins 40 which are closed at their top ends by cap plates 41 welded thereto and of greater diameter than that of the pins 40. Each of the cap plates 41 has a collar 42 secured thereto by bolts 43 and nuts 44. Each collar has inserted therein an upper tubular work support pin 45.

The pins 40 are each uniform as a class as to material and dimensions including thickness and length and the pins 45 are each uniform as another class. Each pin assembly has the same exposure to the heat so that the growth of the pin assemblies under heating is the same.

The lower tubular pins 40 on the upper portions thereof extend through and are welded to spaced upper and lower plates 46 and 47 which are connected at their outer margins by a cylindrical rim 48 to provide a liquid space 49. A heat sink is thus made available in association with the support.

Cooling liquid is supplied to the liquid space 49 by a liquid supply pipe 51 through a manifold or distributor head 52 from which a plurality of pipes 53 extend outwardly and close to the lower plate 47 and rim 48 to distribute the cooling liquid in the space 49.

A return connection 54 is provided through the upper plate 46 for return through pipe 55 of the cooling liquid.

If desired a heat shield 56 can be mounted in the furnace 10 and through which the upper tubular pins 45 extend to reduce the amount of exposure to radiant heat from the heating elements within the tank 11.

The construction of the work support is such that it can be readily machined to close tolerances of the order of plus or minus one thousandth of an inch of a true plane to insure flatness of support for the work piece.

The support can be readily inserted into the furnace and positioned by the locating pins 36 and 38. The pipes 51 and 56 are connected for the supply and return of cooling liquid to the heat sink.

With the work piece in place supported on the pins 45 the furnace 10 can be closed, evacuated to the desired vacuum while being heated by the heating elements 30.

If pressure application on the work piece is desired this may be effected by actuation through the cylinder 25 of the press plunger 24. In a specific embodiment the load of the work piece may be of the order of 7500 pounds, with a ram load of the order of 100 tons and at a maximum temperature of 1200° F. The support is effective to maintain a flat support for the work piece within close tolerances as indicated and if any departure from the tolerances should occur the support can be readily removed, remachined and reinserted.

The support can be utilized in vacuum electric furnaces which are not equipped with a press and for heat treating or brazing, as desired.

I claim:

1. A work support for vacuum electric furnaces which comprises a flat base plate, a plurality of pin members of the same length for load support by their upper end faces secured to and extending vertically upwardly from said plate, heat sink means having an internal passage for circulating a liquid cooling medium above said base plate through which said pin members extend in heat exchange relation.

2. A work support as defined in claim 1 in which a heat shield is provided above said heat sink means and through which said pin members extend.

3. A work support as defined in claim 1 in which said heat sink means includes vertically spaced plates to which said pin members are secured.

4. A work support as defined in claim 1 in which said heat sink means includes members enclosing a liquid space, and members are provided for distribution cooling liquid within said space.

5. A work support as defined in claim 1 in which said pin members comprise a lower pin secured to said base plate, and an upper pin secured to said lower pin above said heat sink means.

6. A work support as defined in claim 5 in which said pins each has a collar thereon with which the other pin is in engagement.

7. A work support as defined in claim 5 in which a heat shield is provided on said upper pins above said heat sink means

8. A work support as defined in claim 1 in which said pin members include tubular portions.

9. A work support as defined in claim 1 in which said base plate has positioning members carried thereon for locating said support in a furnace.

10. A work support as defined in claim 1 in which the upper end faces of said pin members are in a plane.

11. A work support as defined in claim 1 in which the base plate and the upper end faces of said pin members are in spaced parallel planes.

12. A work support as defined in claim 1 in which said pin members are all of the same geometrical configuration and have equal exposed exterior surfaces for exposure to the same thermal environment throughout their lengths to effect uniform growth of the pins.

* * * * *